US005196090A

United States Patent [19]

Corbellini et al.

[11] Patent Number: 5,196,090

[45] Date of Patent: Mar. 23, 1993

[54] METHOD FOR RECOVERING PULP SOLIDS FROM WHITEWATER USING A SIPHON

[76] Inventors: Glauco Corbellini, 33100 Via Carducci 48, Udine, Italy; Peter A. Rodriguez, 1785 Selva Marina Dr., Atlantic Beach, Fla. 32233

[21] Appl. No.: 711,373

[22] Filed: Jun. 5, 1991

Related U.S. Application Data

[63] Continuation of Ser. No. 431,456, Nov. 3, 1989, abandoned.

[51] Int. Cl.[5] ..... D21F 1/66; D21F 1/80

[52] U.S. Cl. ..... 162/190; 162/203; 162/217; 162/264; 162/301; 210/783

[58] Field of Search ..... 162/189, 190, 191, 203, 162/217, 264, 301, 303, 364; 210/783, 400, 401

[56] References Cited

U.S. PATENT DOCUMENTS

| | | | |
|---|---|---|---|
| 3,595,744 | 7/1971 | Skoldkvist | 162/301 |
| 3,619,362 | 11/1971 | Parker | 162/203 X |
| 3,716,449 | 2/1973 | Gatward et al. | 162/190 X |
| 3,806,405 | 4/1974 | Heidweiller | 162/203 X |
| 3,810,817 | 5/1974 | Arledter | 162/203 X |
| 3,840,430 | 10/1974 | Ely | 162/203 X |
| 3,855,057 | 12/1974 | Hill | 162/203 X |
| 3,915,791 | 10/1975 | Langdon | 162/203 X |
| 4,664,749 | 5/1987 | Haapamäki et al. | 162/60 X |
| 4,707,272 | 11/1987 | Kistler | 210/783 X |
| 4,895,623 | 1/1990 | Corbellini | 162/301 X |

OTHER PUBLICATIONS

Morrison "Efficient Reuse of Process Water" TAPPI Aug. 19, 1943.

Fuller "Screening of Effluents" Tappi Jun. 1973.

*Primary Examiner*—Karen M. Hastings

[57] ABSTRACT

Method of feeding separate streams of (1) an aqueous dispersion of pulp and (2) white water from a paper making process into a wedge-shaped space between horizontal travelling upper and lower converging wire meshes, applying a siphon means to the upper wire mesh in said zone to form a web of solid fibrous material between the meshes separating the upper wire mesh from the web to leave it supported on the lower wire mesh as the meshes leave the wedge-spaced zone; washing all solids from the wire meshes into a receiving vessel, recycling the contents of the receiving vessel to the paper making process, and recycling the liquid from the white water to the paper making process; and apparatus to perform the above method.

18 Claims, 5 Drawing Sheets

METHOD FOR RECOVERING PULP SOLIDS FROM WHITEWATER USING A SIPHON

This is a continuation of application Ser. No. 07/431,456, filed on Nov. 3, 1989, now abandoned.

BACKGROUND OF THE INVENTION

Paper making is accomplished today by a process and apparatus involving a traveling screen or fabric, referred herein as a "wire" or "wire mesh". The wire serves as a receptacle to receive a thin layer of aqueous dispersion of wood pulp and associated fibrous materials, which eventually is formed into a sheet of paper on the wire after draining away the water and drying the sheet. Water removed in the wet end of the process is called "whitewater" and it contains a certain amount of fibrous material that the paper manufacturer prefers to recovery and to use in making paper. Wet end formers are found in the early stages of all paper making processes whether they are of the Fourdriner type or other types such as multiply formers, ultraformers, inverformers, belbay formers, synformers, or the like. The method and apparatus of this invention is directed principally at recovering as much as possible of the valuable fibrous material from whitewater and recycling it to the paper making process regardless of which type of wet end former is actually used. It is to be understood however, that this invention may be used to recover valuable materials from other process streams than those of a paper making procedure, e.g., dispersions of other vegetable fibers, such as cotton, animal fibers, such as wool, and synthetic fibers, such as nylon, acrylonitrile, polyester and the like. Furthermore, dispersions of nonfibrous materials can also be subjected to this invention if it is desirable to filter those materials from the liquid of the dispersion, regardless of whether the filtered materials are to be recovered or disposed of as waste.

The basic features of the method and apparatus of parts of this invention are described in a pending patent application Ser. No. 07/080769 filed Aug. 26, 1987 now U.S. Pat. No. 4,895,623, dated Jan. 23, 1990.

It is an object of this to provide a novel method for treating whitewater from a paper making process to recover and recycle the fibrous solids and the water therefrom. It is another object to provide an apparatus for performing such a process. It is still another object to provide a method and apparatus for continuously filtering a liquid dispersion of solids by a procedure that continuously prepares the filter medium. Still other objects will become apparent from the more detailed description which follows.

BRIEF SUMMARY OF THE INVENTION

This invention relates to a method for recovering solid fines from whitewater produced in a paper making process, the method comprising:

(a) feeding whitewater and paper pulp into a wedge-shaped space between upper and lower horizontal, continuously moving, converging wire meshes, said pulp being fed so as to be contiguous to said upper wire mesh and said whitewater being fed between said pulp and said lower wire mesh;

(b) as the upper wire passes through said zone applying a siphon means to said upper wire on the side opposite to the side contiguous to said pulp so as to form a web of pulp and solid fines on said upper wire;

(c) recovering purified water from said siphon means;

(d) directing a water spray at said web to dislodge the web from said wire and to direct it into an aqueous collection pool; and (e) recycling the contents of said pool into said paper making process.

This invention also relates to an apparatus for separating solid fines from water in whitewater produced on the wet end former of a paper making process which comprises:

(a) an endless upper and an endless lower travelling wire mesh arranged to move adjacently parallel to each other in generally horizontal positions through a web-forming zone with the two meshes converging toward each other to define a wedge-shaped space;

(b) drive means and guide means to cause said upper and lower wire meshes to separately maintain said wire meshes adjacently parallel to each other and moving at the same speed;

(c) a feed nozzle/pipe for introducing a dispersion of pulp in water at said entrance and directed to contact said upper wire mesh and be evenly distributed across the width thereof;

(d) a feed pipe for introducing whitewater between said dispersion of pulp in water and said lower wire mesh in a stream substantially evenly distributed across the width of said zone;

(e) a solid fluid flow barrier contiguous to said lower wire mesh on the surface opposite to that which is contacted by said whitewater stream;

(f) a vacuum suction box in contact with said lower wire mesh immediately downstream from said zone and adapted to pull solids trapped between said wire meshes onto said lower wire mesh and be supported thereon;

(g) water sprays positioned downstream of said suction box to wash solid materials from said upper and lower wire meshes into a container to receive spray water and solids washed from said wire meshes;

(h) siphon means to maintain water levels wherein said web-forming zone is continuously submerged in water while water is flowing away from said zone; and (i) a container to receive said water flowing from said zone through said siphon means.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The operation of the apparatus and process of this invention may best be understood by reference to the attached drawings.

Figure 1:
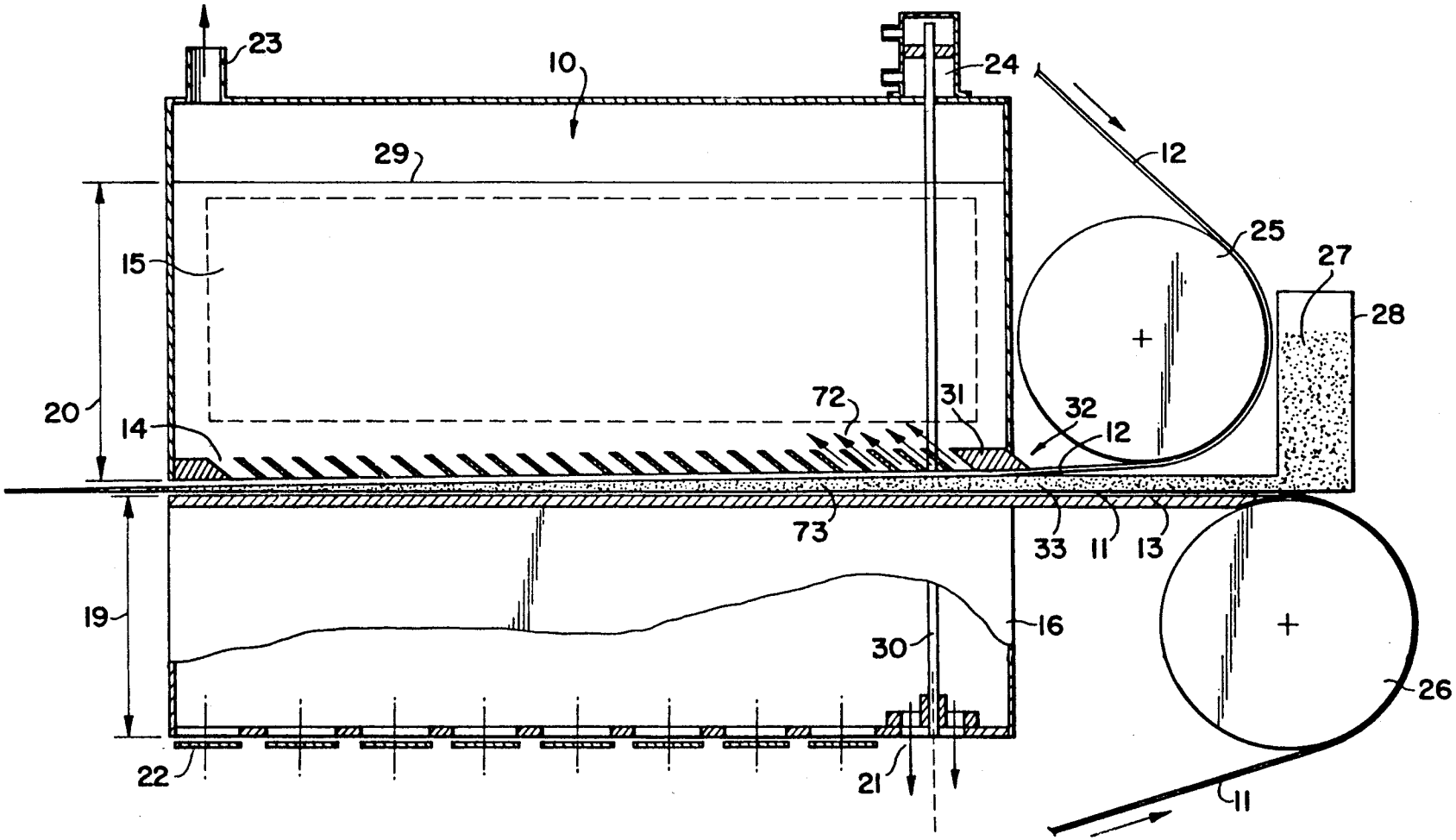
FIG. 1 is a front elevational view of one embodiment of the web-forming portion of the apparatus of this invention in which a single filter web is formed.
Figure 2:
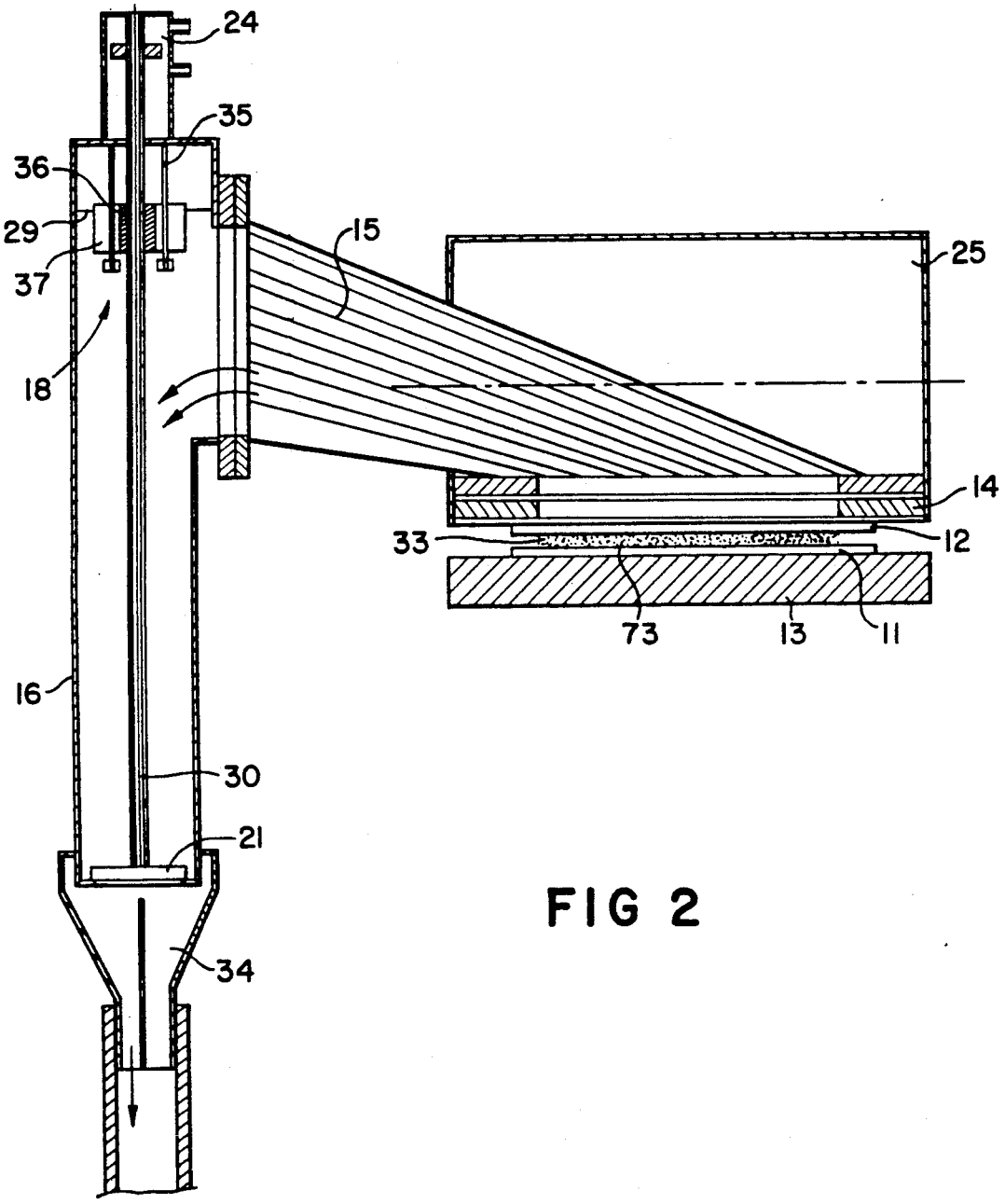
FIG. 2 is a side elevational view of the embodiment shown in FIG. 1.
Figure 3:
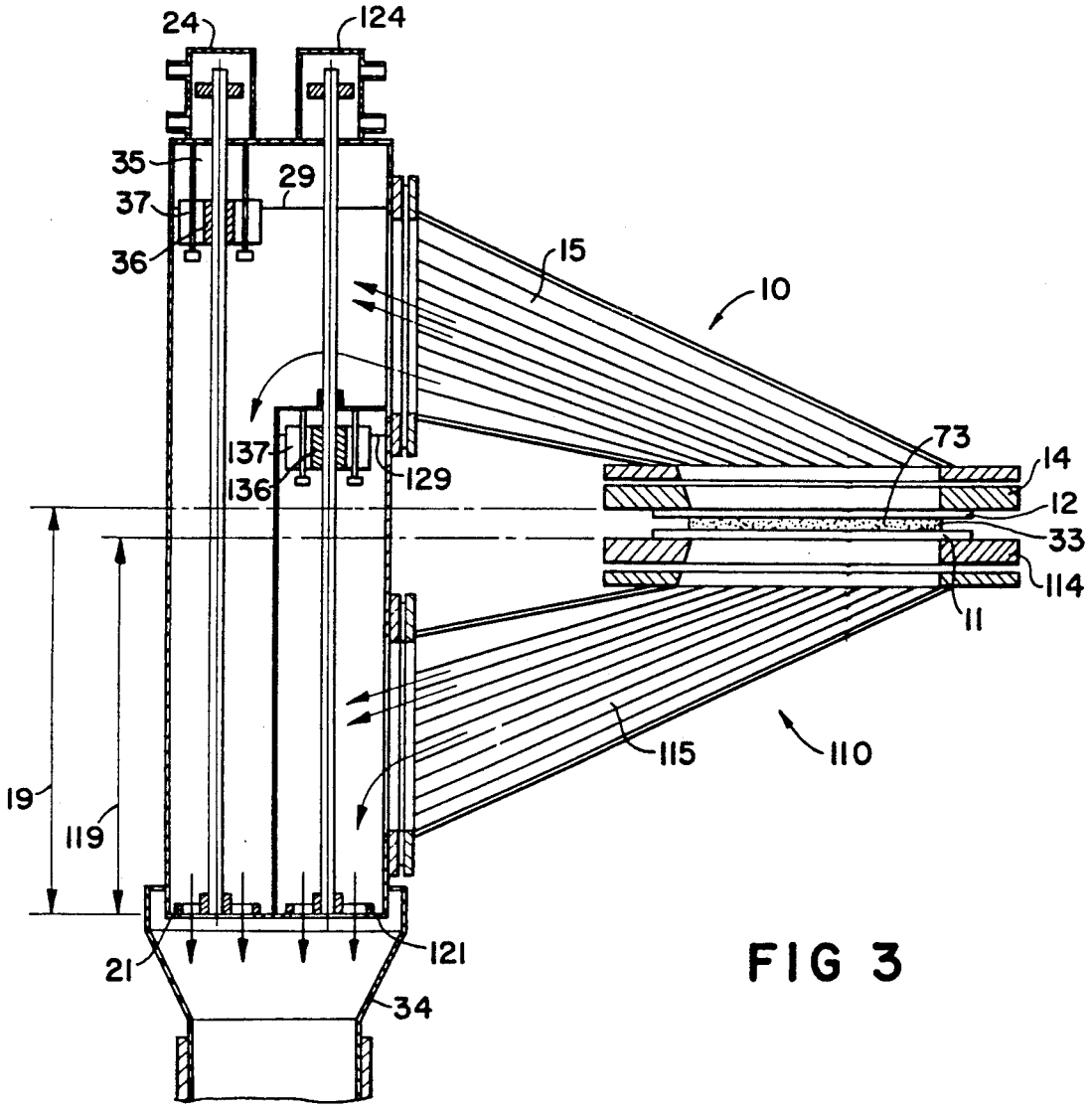
FIG. 3 is a side elevational view of a second embodiment of the web-forming portion of the apparatus of this invention in which a double filter web is formed.

In FIGS. 1-3 there is shown the web forming portion of Fourdrinier type apparatus and process of this invention which function in copending U.S. Pat. application, Ser. No. 07/090,769 filed Aug. 26, 1987 now U.S. Pat. No. 4,895,623, dated Jan. 23, 1990. An upper wire mesh 12 is guided around cylinder 25 to pass under a water removal device 10 which operates as a siphon. Correspondingly, a lower wire mesh 11 is guided around cylinder 26 to travel closely adjacent to wire mesh 12 in a substantially parallel movement with both meshes travelling at the same speed. Lower wire mesh 11 and upper wire mesh 12 actually converge upon each other to define a wedge-shaped space between the two as they travel past water removal device 10. Lower wire mesh 11 is supported on a solid plate 13 which is a fluid flow barrier. Water is removed by a siphon means in a water removal container 10 having a water level 29. Whitewater 27 having fines, etc., therein is fed from source 29 to the upper surface of lower wire mesh 11. As the whitewater passes under water removal container 10 the water in stock 73 is siphoned away by a system whereby the water level in container 10 is at 29 and is controlled through a float system 24 to drain water continuously away through valved exits 21 and 22. During this time of water removal the stock 73 on wire mesh 11 is submerged in water so that no air-water meniscus is present at or near wire mesh 11.

In FIG. 2 there is a more detailed showing of the siphon means and the water level controls wherein water from stock 73 flows upward through manifold 15 to a drainage tank 16.

In FIG. 3 there is shown a similar system to that in FIGS. 1 and 2 except that a siphon means is applied both above and below stock 73 simultaneously. A similar container to water removal container 10 is placed in contact with lower wire mesh 11 instead and plate 13 is removed.

Figure 5:
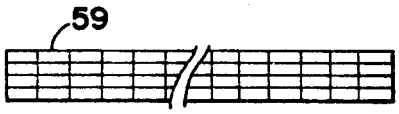
FIG. 5 is a cross section taken at 5—5 of FIG. 4.
Figure 4:
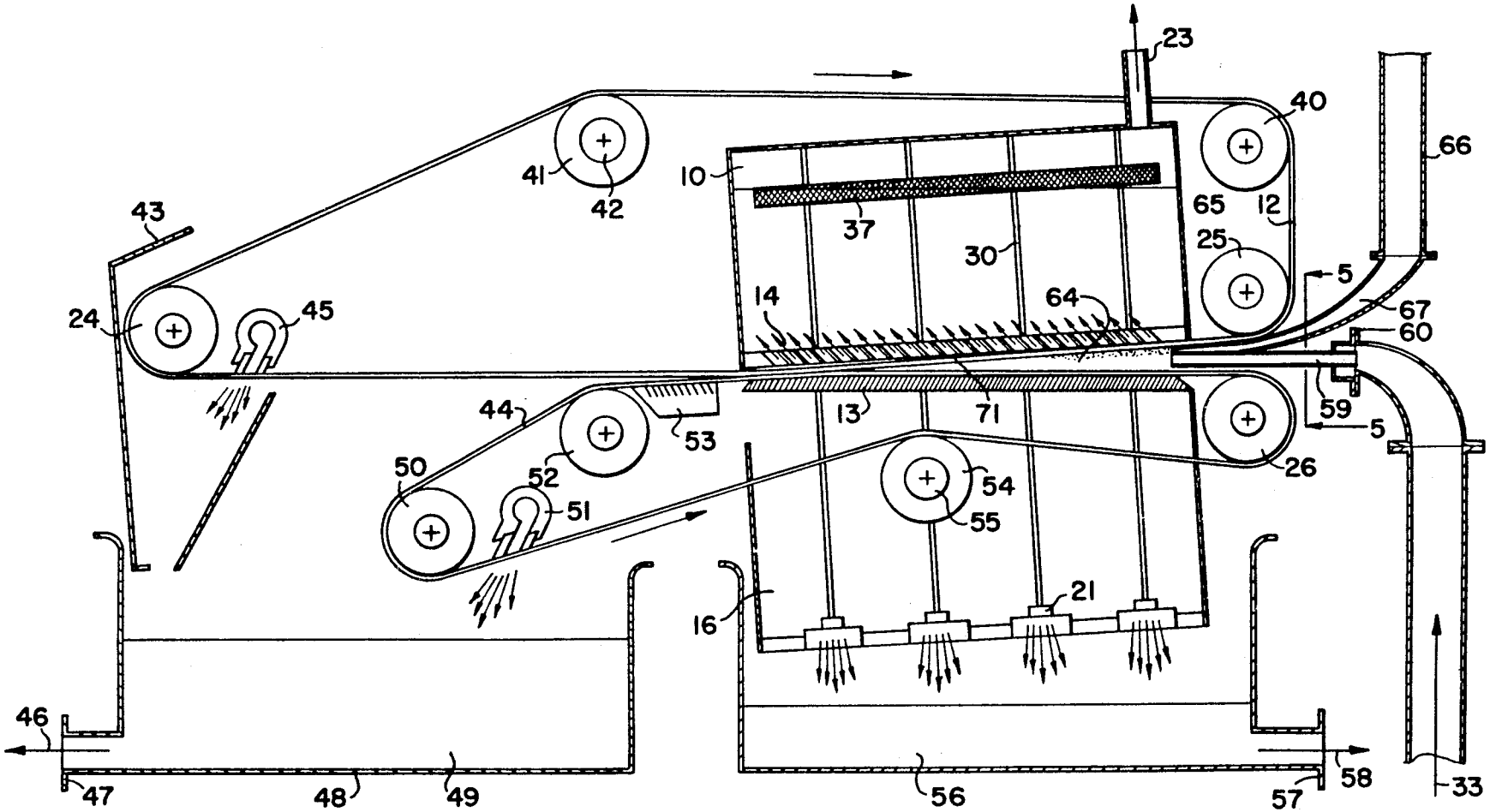
FIG. 4 is a schematic front elevational view of the entire assembly of the apparatus of this invention employing the apparatus of FIGS. 1 and 2.

In the process and apparatus of the present invention the same general principles, as set forth in U.S. Pat. No. 4,895,623, are involved for the treatment of whitewater to recover the pulp-solids therein to recycle them to the paper making process, and at the same time, purifying the liquid phase of the whitewater to produce purified water for use in the paper making process or elsewhere as desired. In FIGS. 4 and 5 there is shown the present invention using the water removal siphon system of FIGS. 1 and 2 and in FIG. 6, there is shown the siphon system of the double sided siphon system of FIG. 3.

With specific reference to FIG. 4 upper wire mesh 12 and lower wire mesh 11 supported on plate 13 approach each other at an angle so as to form a wedge-shaped space 64. Into that space 4 is fed whitewater through pipe 59 from supply line 62. Between the outlet of pipe 59 and upper wire mesh 12 is preferably fed an aqueous dispersion of paper pulp through pipe 67 as a branch from supply line 66. This dispersion may be the same as that used as feed stock 28 from feed box 27 (see FIG. 1) or it may be merely paper pulp in water without the surface active agents, dispersants, bleach and other additives found in paper pulp stock. Pipe 67 terminates so that the outflowing dispersion contacts upper wire mesh 12 where it approaches the leading edge of water removal container 10. Accordingly, the pulp in the dispersion from pipe 67 is sucked against wire mesh 12 and forms a filter web as wire mesh 12 moves across the siphon mouth 14 of container 10. Water cannot flow downwards from wedge-shaped space 64 because of the presence of fluid flow barrier plate 13 supporting lower wire mesh 11.

After passing beyond the downstream end of container 10 upper wire mesh 12 and lower wire mesh 11 are directed apart from each other so as to be returned to pass through the system again. At this point a suction box 53 pulps the filter web 71 from upper wire mesh 12 to lower wire mesh 11 and then passes under a strong water spray 51 which washes the filter web 71 off mesh 11 and allows it to drop into a pool 49 of concentrated pulp in collection tank 48, from whence it can exit at 47 in the direction of 46 to be recycled to the paper process. Upper wire mesh 12 passes under another water spray 45 to wash off any remaining pulp fiber clinging thereto.

Whitewater from pipe 59 is sucked through filter web 71 causing any solids (usually fines of fiber and similar materials to be caught by the filter web 71 and the filtered water passes through valved outlets 21 to a pool 56 which is conducted out exit 57 in the direction of arrow 58 for use elsewhere, e.g., in sprays 45 and 51 or other places in the paper plant.

In FIG. 5 there is shown a cross section of pipe 59 to show how the whitewater is directed to be evenly distributed across the entire width of wire meshes 11 and 12 and to break up any large clumps or to restrain extraneous matter from entering between the wire meshes.

Figure 6:
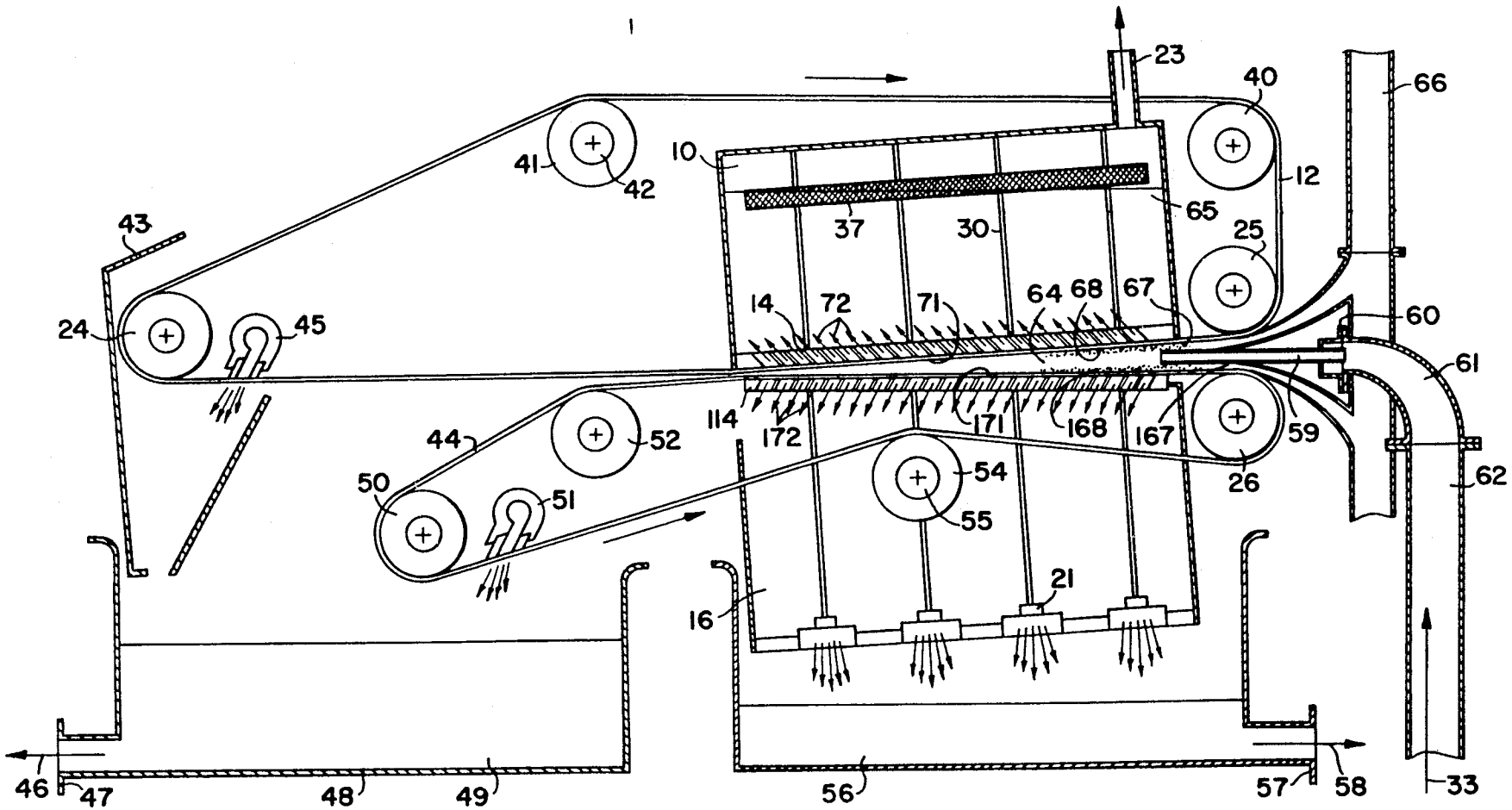
FIG. 6 is a schematic front elevational view of the entire assembly of the apparatus of this invention employing the apparatus of FIG. 3.

In FIG. 6 the same process and apparatus as in FIG. 4 is employed except that fluid barrier 13 is removed and in its place there is put a lower siphon means with a mouth with deflectors and a water removal container (similar to 10 but not shown for the sake of simplicity). Whitewater is fed from pipe 59 into the center of the wedge-shaped space 64 while a pulp dispersion from supply line 66 is fed through pipe 67 to contact upper wire mesh 12 and also through pipe 167 to contact lower wire mesh 11. In this fashion a filter web 71 is formed on upper wire mesh 12 and a similar filter web 171 is formed on lower wire mesh 11 with whitewater fed in between. The siphon system pulls water through both filter webs, 71 and 171 to be collected in pool 56 and recycled through exit 57 to the paper making process. The two filter webs 71 and 171 continue in contact with their respective wire meshes 12 and 11 until both are washed off by sprays 45 and 51 into pool 49 of concentrated pulp which is recycled through exit 47 to the paper making process. Suction box 53 (see FIG. 4) is eliminated in this arrangement because it is not normally needed, although a suction box. may, if desired, be included on the lower wire mesh downstream from container 10.

It is to be understood that the system of this invention can be used to filter other media than whitewater. Any dispersion of solids in a liquid (particularly in water) can be treated by the present invention to separate the solids and purify the water.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. Recovering method which removes solid fines from white water produced from a paper making process and which recovers purified water therefrom, the method comprising:

(a) feeding white water and an aqueous dispersion of paper pulp into a wedge-shaped space between upper and lower horizontal, continuously moving, converging paper-making wire meshes in a horizontal zone, the aqueous dispersion of paper pulp being fed so as to be contiguous to the upper wire mesh subsequently to form a filter web thereon and the white water being fed between the aqueous dispersion of paper pulp and the lower wire mesh;

(b) applying a siphon means as the upper wire passes through the horizontal zone to the upper wire on the side opposite to the side contiguous to the aqueous dispersion of paper pulp so as to form the filter web of pulp and solid fines on the upper wire mesh and remove a resultant purified water through the filter web and the upper wire mesh, wherein the siphon means includes a siphon mouth in contact with the upper wire mesh while the upper wire mesh is submerged in water flowing into the siphon means and being discharged at a distant location without a meniscus forming at an interface between water and air in the upper wire mesh;

(c) recovering the purified water from the siphon means to be used in showers and elsewhere in the paper making process;

(d) dislodging the filter web and solid fines from the upper wire and directing the filter web and solid fines into an aqueous collection pool; and (e) recycling the aqueous collection pool into the paper making process.

2. The method of claim 1 wherein the lower wire mesh is supported from underneath and slides on a solid horizontal fluid barrier while the upper wire mesh is subjected to the siphon means.

3. The method of claim 1 wherein the filter web is formed on the upper wire mesh to initiate closure of the upper wire mesh by paper pulp in the aqueous dispersion of paper pulp to enhance purification of the resultant purified water.

4. The method of claim 3 wherein the filter web and solid fines on the upper wire mesh are subsequently transferred to the lower wire mesh by applying a suction means to pull the filter web and solid fines from the upper wire mesh to the lower wire mesh.

5. The method of claim 4 wherein the filter web and solid fines are subsequently washed off the lower wire mesh and into the aqueous collection pool by a water spray directed at the filter web.

6. The method of claim 5 wherein the upper wire mesh, after the filter web and solid fines are removed therefrom, are washed by a water spray to remove any remaining pulp or solid fines therefrom and direct same to the collection pool.

7. The method of claim 1 wherein step (a) includes feeding another aqueous dispersion of paper pulp contiguous with the lower mesh to form another filter web thereon, and the white water being fed between the filter web and the another filter web.

8. The method of claim 7 wherein step (b) additionally includes applying a siphon means to the lower wire mesh on the side opposite to the side contiguous to the another filter web.

9. Recovering method which recovers purified water and removes solid fines from white water produced from a paper making process, the method comprising the steps of:

(a) feeding white water and an aqueous dispersion of paper pulp into a wedge-shaped space between upper and lower horizontal, continuously moving, converging paper-making wire meshes with the aqueous dispersion of paper pump being fed so as to be contiguous to the lower side of the upper wire mesh and the white water being fed between the aqueous dispersion of paper pulp and the upper side of the lower wire mesh;

(b) applying a siphon means to the upper side of the upper wire mesh so as to form a filter web of pulp and solid fines on the upper wire mesh and remove a resultant purified water through the filter web and upper wire mesh, and positioning a siphon mouth of the siphon means in contact with the upper wire mesh while the upper wire mesh is submerged in white water flowing into the siphon means and the resultant purified water being discharged at a distant location without a meniscus forming at an interface between water and air in the upper wire mesh;

(c) dislodging the filter web of pulp and solid fines from the upper wire mesh and discharging same into an aqueous collection pool;

(d) recycling the aqueous collection pool into the paper making process; and (e) recovering the purified water from the siphon means for use in showers and elsewhere in the paper making process.

10. The method of claim 10 further comprising the step of:

(f) supporting the lower wire mesh with its lower side on a solid horizontal fluid barrier on which the lower wire mesh slides while the adjacent upper wire mesh is subjected to the siphon means in step (b).

11. The method of claim 10 further comprising the step of:

(f) cleaning the wire meshes after step (c).

12. The method of claim 10 wherein step (c) includes the step of:

(f) transferring the filter web and solid fines from the upper wire to the upper side of the lower wire mesh by applying a suction means below the lower side of the lower wire mesh to pull the filter web and solid fines from the upper wire mesh to the lower wire mesh.

13. The method of claim 12 wherein step (c) includes the step of:

(g) spraying purified water onto the lower side of the lower wire mesh and then allowing it to drain into the aqueous collection pool.

14. The method of claim 13 further comprising the step of:

(h) cleaning the upper wire mesh after removal of the filter web and solid fines therefrom by spraying water from the upper side thereof, thereby removing any remaining pulp or solids fines therefrom and directing same to the aqueous collection pool.

15. The method of claim 9 wherein step (a) includes the step of:

(f) feeding another aqueous dispersion of paper pulp so as to be contiguous with the upper side of the lower wire mesh to locate the white water being fed between the aqueous dispersions of paper pulp contiguous with the respective upper and lower wire meshes.

16. The method of claim 15 wherein step (b) includes the step of:

(g) applying a siphon means to the lower side of the lower wire mesh so as to form a filter web of pulp and solid fines on the lower wire mesh, and positioning a siphon mouth of the lower side siphon means in contact with the lower side of the lower mesh while the lower mesh is submerged in white water flowing into the lower side siphon means and being discharged at a distant location without a meniscus forming at an interface between water and air in the lower wire mesh.

17. The method of claim 16 further comprising the step of:

(h) dislodging the filter web and solid fines from the lower wire mesh into the aqueous collection pool; the method further comprising the step of:

(i) cleaning the upper and lower wire meshes after respective steps (c) and (h).

18. The method of claim 17 wherein step (c) includes the step of:

(j) spraying water onto the underside of the lower wire mesh and into the aqueous collection pool; and step (h) includes the step of:

(k) spraying water onto the underside of the upper wire mesh and into the aqueous collection pool.

* * * * *